US008427387B1

(12) United States Patent
Josypenko

(10) Patent No.: US 8,427,387 B1
(45) Date of Patent: Apr. 23, 2013

(54) BROADBAND SPIRAL TRANSMISSION LINE PHASE SHIFTING POWER SPLITTER

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 353 days.

(21) Appl. No.: 12/894,658

(22) Filed: Sep. 30, 2010

(51) Int. Cl.
*H01Q 1/50* (2006.01)
*H01Q 1/36* (2006.01)

(52) U.S. Cl.
USPC ..... 343/859; 343/860; 343/865; 343/895

(58) Field of Classification Search ..... None
See application file for complete search history.

(56) References Cited

U.S. PATENT DOCUMENTS

| | | | | |
|---|---|---|---|---|
| 7,623,006 | B2 * | 11/2009 | Ezzeddine et al. | 333/131 |
| 8,008,799 | B2 * | 8/2011 | Rofougaran | 307/3 |
| 8,203,416 | B2 * | 6/2012 | Ezzeddine | 336/200 |
| 2001/0006374 | A1 * | 7/2001 | Erikmats et al. | 343/860 |
| 2007/0296519 | A1 * | 12/2007 | Ezzeddine et al. | 333/131 |
| 2009/0066461 | A1 * | 3/2009 | Ezzeddine | 336/200 |
| 2011/0300813 | A1 * | 12/2011 | Mirzaei et al. | 455/78 |

* cited by examiner

*Primary Examiner* — Trinh Dinh
(74) *Attorney, Agent, or Firm* — James M. Kasischke; Jean-Paul A. Nasser; Michael P. Stanley

(57) ABSTRACT

A broadband power splitter and phase shifter having a plurality of transmission lines, a 3 db, zero degree power splitter for splitting a signal, an open quadrifilar spiral for receiving a first signal and reflecting power, a modified, open quadrifilar spiral for receiving a second output after a delay and for reflecting power, and wherein a difference between the reflected power from the open quadrifilar spiral and the modified, open quadrifilar spiral in conjunction with a delay provides a constant phase shift over a broad range of frequencies.

13 Claims, 3 Drawing Sheets

BROADBAND SPIRAL TRANSMISSION LINE PHASE SHIFTING POWER SPLITTER

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

(1) FIELD OF THE INVENTION

The present invention relates generally to transmission lines and more particularly, to broadband spiral transmission line phase shifting power splitters.

(2) DESCRIPTION OF THE RELATED ART

U.S. Pat. No. 6,133,891, hereby incorporated by reference, describes spiral transmission lines. This patent describes two spirals that are crossed to form two crossed transmission lines comprising elements for feeding and matching a quadrifilar helix. The two transmission lines are balanced and are of constant or smoothly changing characteristic impedance, $Z_0$, with length except for the last ½ of a turn of any given element on the outermost circumference. For a given transmission line length, the given filar has filars on both of its sides. However for the last ½ turn, the given filar has only one opposite filar, which is on the side closest to the feed points (the central region) of the spiral. This increases the $Z_0$ of the transmission line along this ½ turn causing a mismatch.

The mismatch shows up as a small increased antenna mismatch when the transmission line is used to feed and match the antenna. If the width of the filar is increased in the area of the ½ turn to increase capacitance to the opposite filar, the $Z_0$ between the ½ turn of filar and its opposite transmission line filar decreases back to normal. But now the capacitance between the opposite filar and its two surrounding opposite filars, which includes the widened ½ turn of filar, becomes larger than normal resulting in its $Z_0$ becoming lower than normal. Thus, this attempt at fixing the first mismatch of the ½ turns of filar creates a second mismatch.

SUMMARY OF THE INVENTION

The present invention features a broadband power device in the form of a phase shifting power splitter. A circuit in the broadband power device splits an incoming signal into two equal outputs. The first output is received by an open quadrifilar spiral, and the second output is received by a modified, open quadrifilar spiral. The open quadrifilar spiral and the modified, open quadrifilar spiral reflect their received powers. The phase difference between the power reflected from the open quadrifilar spiral and the modified, open quadrifilar spiral, with some delay, is broadband or occurs over a large bandwidth (e.g., 2:1).

BRIEF DESCRIPTION OF THE DRAWINGS

These and other features and advantages of the present invention will be better understood in view of the following description of the invention taken together with the drawings wherein.

DETAILED DESCRIPTION OF THE INVENTION

Figure 1:
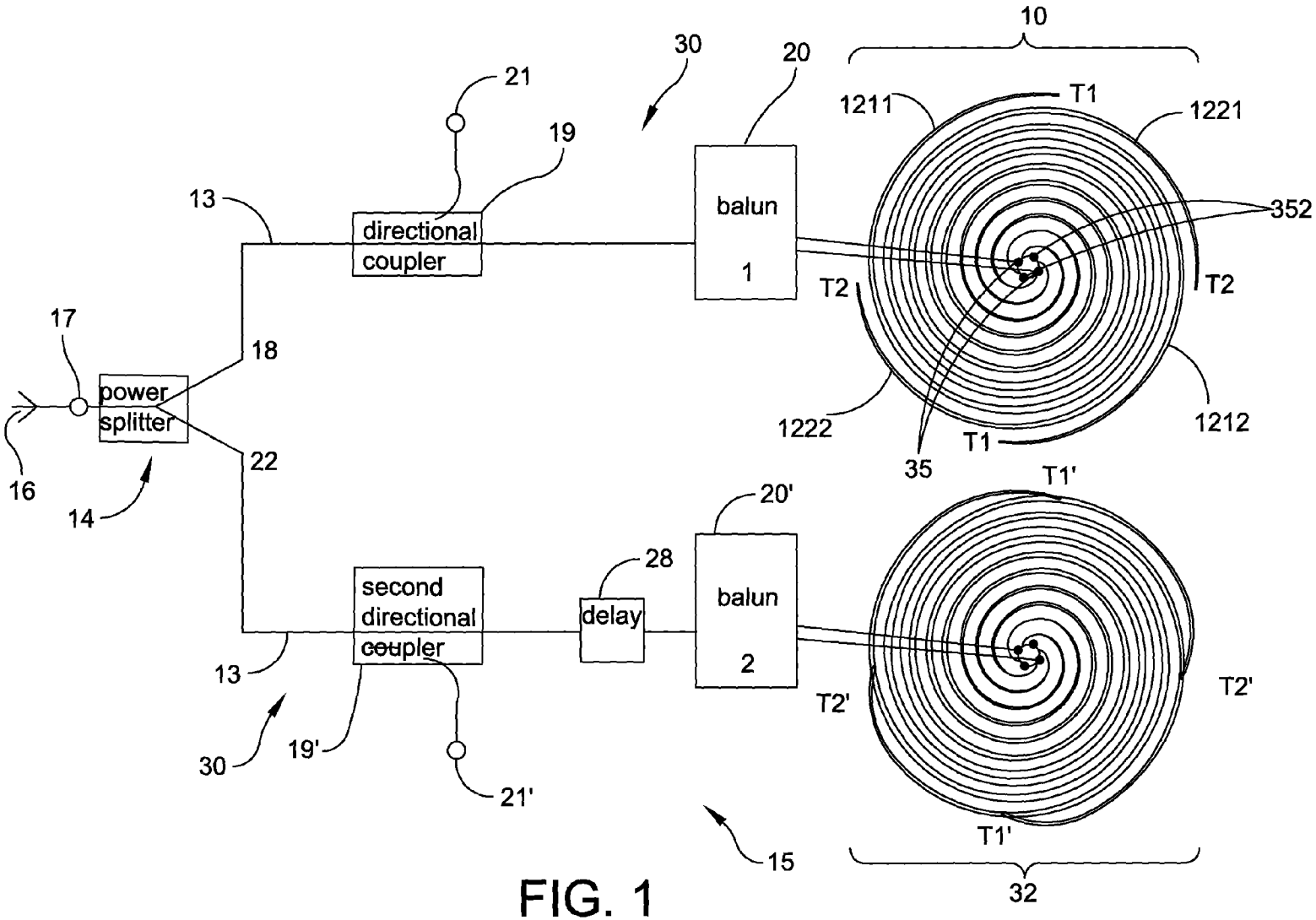
FIG. 1 is a schematic of a broadband spiral transmission line phase shifting power splitter according to the present invention.

A circuit 30, as illustrated in FIG. 1, according to the present invention incorporates an open quadrifilar spiral 10 and a modified, open quadrifilar spiral 32 into a broadband spiral transmission line power device 15. The broadband spiral transmission line power device 15 according to the present invention splits an incoming signal 16 into two signals separated by a phase that can be varied roughly from 0 to 180 degrees.

The open quadrifilar spiral 10 is known in the prior art and has four filars 1211, 1212, 1221, and 1222. A given pair of radially opposite filars form a spiral transmission line, thus with four filars separated by 90° between adjacent filars, two spiral transmission lines separated by 90° are formed. Filars 1211 and 1212 form transmission line T1. Filars 1221 and 1222 form transmission line T2. The quadrifilar has used feed points 35 for transmission lines T2. Feed points 352 for transmission line T1 are not used. The open quadrifilar spiral 10 is approximately eight inches in width, and the filars 1211, 1212, 1221, and 1222 have a width of 0.975% of the available width at the feed points 35.

The modified, open quadrifilar spiral 32, along with some transmission line delay 28, according to the present invention is used as a phase shifter, when referenced to the first open quadrifilar spiral 10. The modified, open quadrifilar spiral 32 increases the capacitance between its filars.

Figure 2:
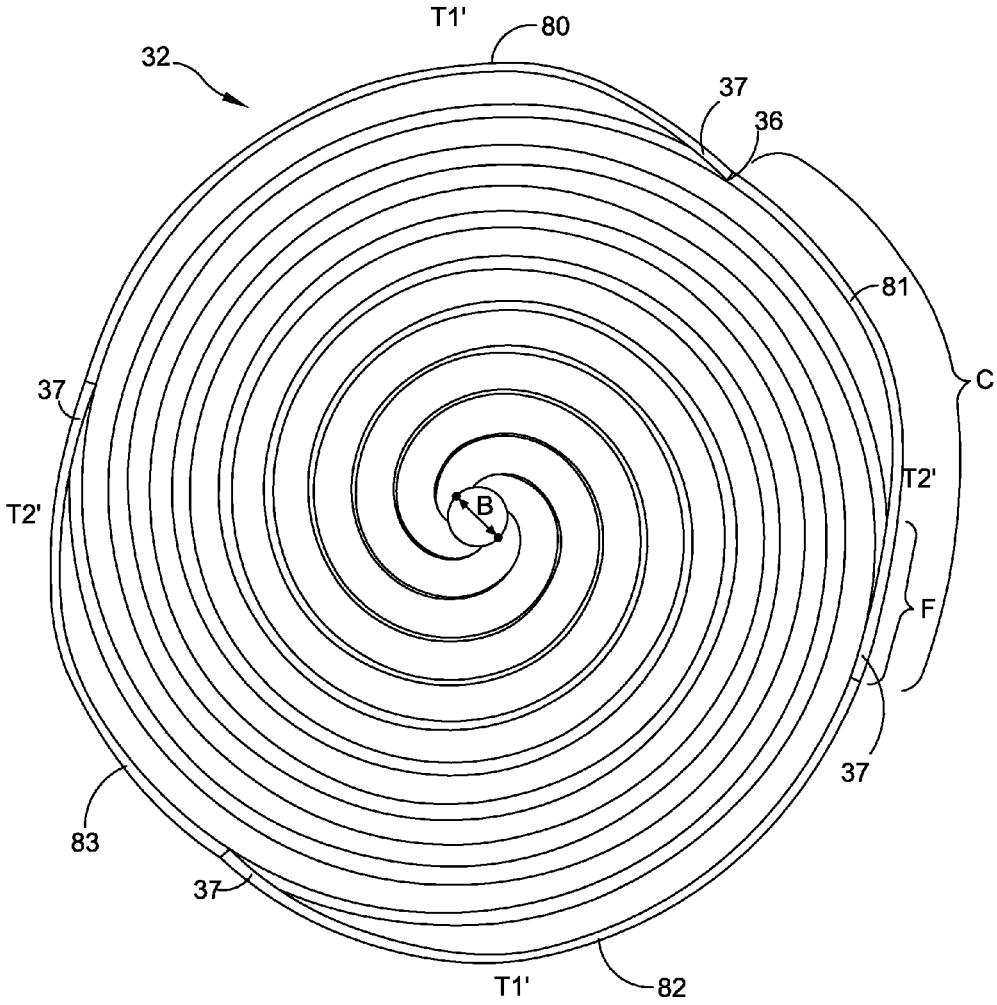
FIG. 2 is a modified, open quadrifilar spiral shown in FIG. 1 according to the present invention.

The modified, open quadrifilar spiral 32, FIG. 2, has four filars, wherein all of the four filars 80, 81, 82, 83 overlap their adjacent respective filars 81, 82, 83, 80 for some part of their last ¼ of a turn.

Each pair of radially opposite filars (i.e., 80 & 82 and 81 & 83) constitutes a transmission line T1' and T2', respectively. Ideally, the impedance of a normal open transmission line is an open circuit. For the unmodified spiral, however, it is a locus whose reflection coefficient phase oscillates a small amount with frequency about a true open at lower frequencies. At higher frequencies, the locus starts to settle in on a constant value of phase (the delay becomes constant). There are some radiation losses for either quadrifilar spiral at higher frequencies because either quadrifilar spiral starts to become electrically large.

The following description of the modified, open quadrifilar spiral 32 is limited to one filar of the spiral; however, the same modifications are made to the other 3 filars. A given filar 81 of transmission line T2' of the modified, open quadrifilar spiral 32 has its last ¼ turn modified as identified as portion C. Filar 81 of the modified ¼ turn C is surrounded by opposite filars 80 and 82 of the transmission line T1'. An end 36 of one of the filars 80 of the transmission line T1' has an initial width of 0.18 of the available width, which originally tapered down to 0 width at the end of the filar. The tapered section was removed. The other filar of the transmission line T2' is 83. Filar 82 of transmission line T1' is inserted between C and filar 83 of transmission line T2'. An overlap F is an area of overlap between the first filar 81 of the transmission line T2' and the filar 82 of the transmission line T1'. The filars do not touch. There is a space between the two filars that in practice is realized by insertion of a thin layer of dielectric 37 between the two filars. The result is a distributed capacitance between the two filars in the overlap area F. The spiral 32 is fed across the two filars 81 and 83 at the center of the spiral at B.

An unexpected result occurs with the modified, open quadrifilar spiral 32. The roughly constant open circuit impedance locus before modification (i.e. when the quadrifilar spiral is in the form as illustrated in 10) became after modification a roughly constant impedance locus at a reflection coefficient value of 0-j after a change in the impedance reference plane location. This demonstrates a broadband phase shift of ninety degrees. Varying the length of the overlap allowed other broadband phases. For instance, having no overlap gave 0 degrees. Larger overlaps gave phases larger than 90 degrees, approaching 180 degrees.

Referring again to FIG. 1, the circuit 30 incorporating the open quadrifilar spiral 10 and the modified, open quadrifilar spiral 32 into the broadband spiral transmission line power device 15 is shown. The broadband spiral transmission line phase shifting power divider device 15 splits the incoming signal 16 into two signals separated by roughly ninety or other degrees. The broadband spiral transmission line power device 15 receives the incoming signal 16 at an input 17. The incoming signal 16 travels from the input 17 to a 3 db power splitter 14. The 3 db power splitter is well known in the art. The power splitter 14 splits the incoming signal 16 into a first output 18 and a second output 22.

The first output 18 travels through a directional coupler 19 to a balun 20 to the open quadrifilar spiral 10. Reflected power from the open quadrifilar spiral 10 proceeds back through the balun 20 and into the directional coupler 19. A portion of the reflected power is received at a coupled port 21 of the directional coupler 19.

The second output 22 travels through a directional coupler 19', through a delay 28, and then to a balun 20' to the modified, open quadrifilar spiral 32. An enlarged view of the modified, open quadrifilar spiral 32 is shown in FIG. 2. Reflected power from the modified, open quadrifilar spiral 32 proceeds back through the balun 20', through the delay 28, and into the directional coupler 19'. A portion of the reflected power is received at a coupled port 21' of the directional coupler 19', which has a 90° or other degree phase shift relative to coupled port 21 of the directional coupler 19.

The delay 28 is a removal of a length of the connecting transmission line between directional coupler 19' and balun 20' needed for moving the reference plane a small distance beyond the overlap area F at the end of filar 81 in overlap area C, as if the end of the filar extended the small distance.

The difference in signals between the coupled port 21 and the coupled port 21' is a broadband 90° or other degrees. Specifically, there is an approximately 90° or other degree phase difference between the reflected signals of the open quadrifilar spiral 10, and the modified, open quadrifilar spiral 32 plus delay 28, providing an approximately constant phase shift over a broad range of frequencies. The open quadrifilar spiral 10 and the modified, open quadrifilar spiral 32 before modification have the same original dimensions to ensure broadband nature, so that the impedance with frequency about the open at the end of open quadrifilar spiral 10 occurs in the same manner as with the modified spiral before it is modified (i.e., one starts with identical spirals).

Figure 3:
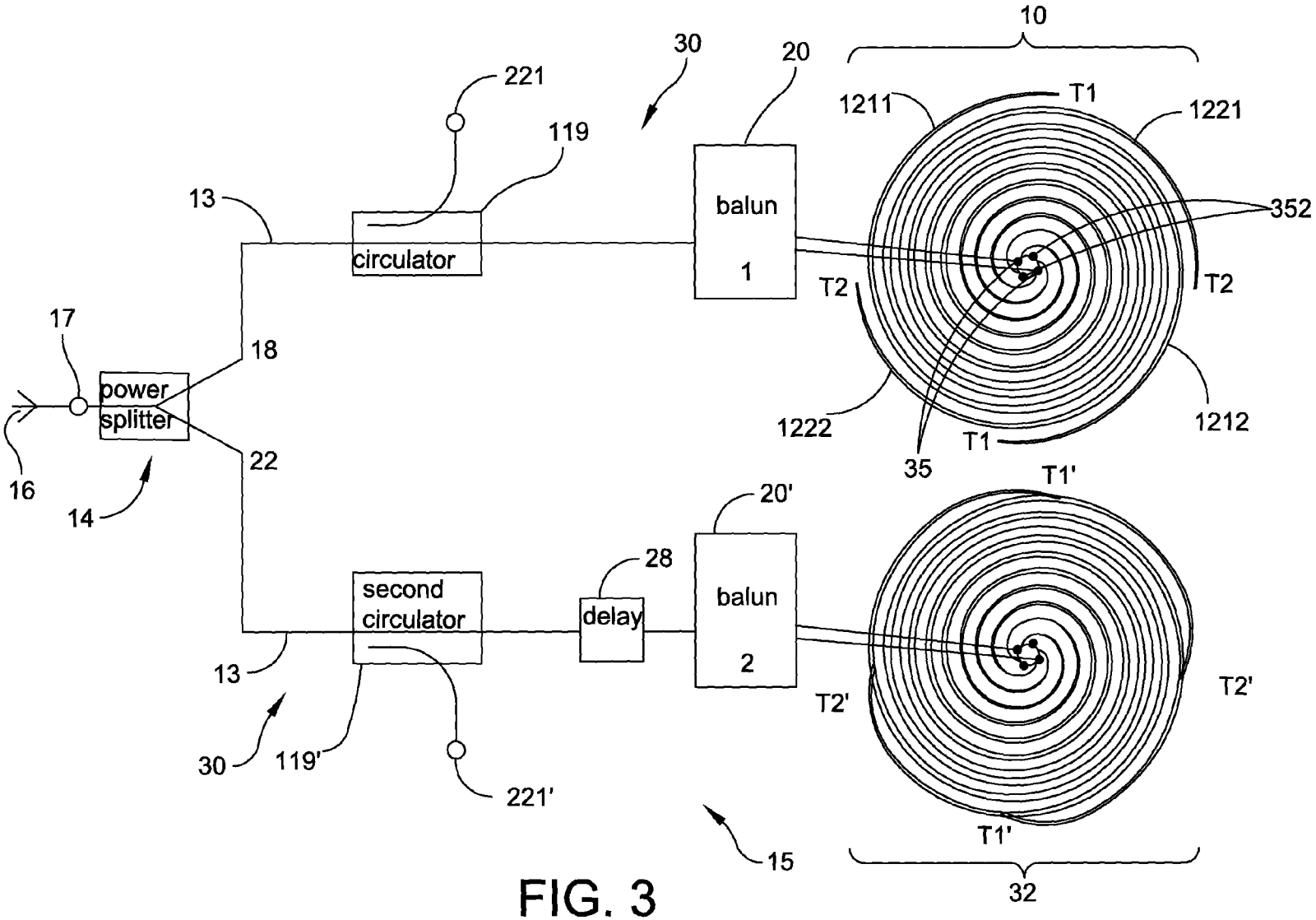
FIG. 3 is a schematic of a broadband spiral transmission line phase shifting power splitter according to an alternative embodiment of the present invention.

The broadband spiral transmission line phase shifting power divider device 15 illustrates a means for creating a broadband ninety or other degree power splitter. However, it has significant power loss due to the use of directional couplers. Referring to FIG. 3, in an alternative embodiment, the directional coupler 19 and the directional coupler 19' are replaced with circulators 119 and 119', so that all of the reflected power from the open quadrifilar spiral 10 and the modified, open quadrifilar spiral 32 end up at the reflection transfer ports 221 and 221' of the circulators corresponding to the coupled port 21 and the coupled port 21', respectively of the directional couplers.

In light of the above, it is therefore understood that within the scope of the appended claims, the invention may be practiced otherwise than as specifically described.

What is claimed is:

1. A broadband spiral transmission line phase shifting power divider device having a plurality of transmission lines, comprising:

an input for receiving a signal;

a power splitter, coupled to said input, for splitting the signal received at the input into a first output and a second output;

a directional coupler, for receiving the first output signal, and for providing a directional coupler output, said directional coupler having a coupler port;

a balun for receiving the directional coupler output from the coupler port of the directional coupler and for providing a balun output;

an open quadrifilar spiral, for receiving the balun output from the balun and for reflecting power;

a second directional coupler for receiving the second output, said second directional coupler having a second coupler port;

a delay for receiving a second directional coupler output from the second directional coupler;

a second balun for receiving a delay output from the delay;

a modified, open quadrifilar spiral, for receiving a second balun output from the second balun and for reflecting power; and wherein a difference in reflected power between the reflected power from the open quadrifilar spiral and the delayed reflected power from the modified, open quadrifilar spiral provides an approximately constant phase shift over a broad range of frequencies.

2. The broadband spiral transmission line phase shifting power splitter device according to claim 1, wherein the modified, open quadrifilar has a first transmission line and a second transmission line, each of the transmission lines has two radially opposite filars, and wherein both of the filars of the first transmission line and both of the filars of the second transmission line overlap at their ends with the adjacent filar, with a layer of dielectric material disposed between the overlapping sections of said filars such that they do not make physical contact.

3. The broadband spiral transmission line phase shifting power splitter device according to claim 2, wherein the open quadrifilar has a first transmission line and a second transmission line, each of the transmission lines has two filars, wherein only one of the two transmission lines of each of the two quadrifilar spirals is fed.

4. The broadband spiral transmission line phase shifting power splitter device according to claim 3, wherein the reflected power from the open quadrifilar spiral is received by the directional coupler and the reflected power from the modified, open quadrifilar spiral is received by the second directional coupler.

5. The broadband spiral transmission line phase shifting power splitter device according to claim 4, wherein the reflected power from the modified, open quadrifilar spiral passes through a delay before being received by the second directional coupler.

6. The broadband spiral transmission line phase shifting power splitter device according to claim 5, wherein a portion of the reflected power from the open quadrifilar spiral is received by the coupled port of the directional coupler and a portion of the reflected power from the modified, open quadrifilar spiral is received by the second coupled port of the second directional coupler.

7. The broadband spiral transmission line phase shifting power splitter device according to claim 6, wherein the reflected power from the open quadrifilar spiral passes through the balun before being received by the directional coupler and the reflected power from the modified, open quadrifilar spiral passes through the second balun before being received by the second directional coupler.

8. A broadband spiral transmission line phase shifting power divider device having a plurality of transmission lines, comprising:

an input for receiving a signal;

a power splitter, coupled to said input, for splitting the signal received at the input into a first output and a second output;

a first circulator, for receiving the first output signal, and for providing a circulator output, said first circulator having a first reflection transfer port;

a balun for receiving the first circulator output from the first reflection transfer port of the first circulator and for providing a balun output;

an open quadrifilar spiral, for receiving the balun output from the balun and for reflecting a second circulator for receiving the second output and for providing a circulator output, said second circulator having a second reflection transfer port;

a delay for receiving a second circulator output from the second circulator;

a second balun for receiving a delay output from the delay;

a modified, open quadrifilar spiral, for receiving a second balun output from the second balun and for reflecting power; and wherein a difference in reflected power between the reflected power from the open quadrifilar spiral and the delayed reflected power from the modified, open quadrifilar spiral provides an approximately constant phase shift over a broad range of frequencies.

9. The broadband spiral transmission line phase shifting power splitter device according to claim 8, wherein the modified, open quadrifilar has a first transmission line and a second transmission line, each of the transmission lines has two radially opposite filars, and wherein both of the filars of the first transmission line and both of the filars of the second transmission line overlap at their ends with the adjacent filar, with a layer of dielectric material disposed between the overlapping sections of said filars such that they do not make physical contact.

10. The broadband spiral transmission line phase shifting power splitter device according to claim 9, wherein the open quadrifilar has a first transmission line and a second transmission line, each of the transmission lines has two filars, wherein only one of the two transmission lines of each of the two quadrifilar spirals is fed.

11. The broadband spiral transmission line phase shifting power splitter device according to claim 10, wherein the reflected power from the open quadrifilar spiral is received by the first circulator so that all of the reflected power from the open quadrifilar spiral ends up at the first reflection transfer port and the reflected power from the modified, open quadrifilar spiral is received by the second circulator so that all of the reflected power from the modified, open quadrifilar spiral ends up at the second reflection transfer port.

12. The broadband spiral transmission line phase shifting power splitter device according to claim 11, wherein the reflected power from the modified, open quadrifilar spiral passes through a delay before being received by the second circulator.

13. The broadband spiral transmission line phase shifting power splitter device according to claim 12, wherein the reflected power from the open quadrifilar spiral passes through the balun before being received by the first circulator and the reflected power from the modified, open quadrifilar spiral passes through the second balun before being received by the second circulator.

* * * * *